US009659545B2

(12) United States Patent
Cho et al.

(10) Patent No.: US 9,659,545 B2
(45) Date of Patent: May 23, 2017

(54) DISPLAY APPARATUS AND METHOD OF DRIVING THE SAME

(71) Applicant: Samsung Display Co., LTD., Yongin, Gyeonggi-Do (KR)

(72) Inventors: Hyun-Min Cho, Hwaseong-si (KR); Jae-Byung Park, Seoul (KR); Hae-Il Park, Seoul (KR)

(73) Assignee: Samsung Display Co., Ltd. (KR)

( * ) Notice: Subject to any disclaimer, the term of this patent is extended or adjusted under 35 U.S.C. 154(b) by 816 days.

(21) Appl. No.: 13/720,274

(22) Filed: Dec. 19, 2012

(65) Prior Publication Data

US 2013/0300771 A1 Nov. 14, 2013

(30) Foreign Application Priority Data

May 11, 2012 (KR) ..... 10-2012-0050512

(51) Int. Cl.

| | |
|---|---|
| ***G06G 1/00*** | (2006.01) |
| ***G09G 5/02*** | (2006.01) |
| ***G09G 3/34*** | (2006.01) |

(52) U.S. Cl.

CPC ..... *G09G 5/026* (2013.01); *G09G 3/3406* (2013.01); *G09G 3/3413* (2013.01); *G09G 2310/0235* (2013.01)

(58) Field of Classification Search

CPC ..... G09G 1/00; G09G 3/3406; G09G 3/342; G09G 2320/064; G09G 3/3648; G09G 2310/0237

USPC ..... 345/102

See application file for complete search history.

(56) References Cited

U.S. PATENT DOCUMENTS

| | | | | |
|---|---|---|---|---|
| 2007/0057901 | A1* | 3/2007 | Chino | G09G 3/2003 345/102 |
| 2012/0281025 | A1* | 11/2012 | Hanamoto | G09G 3/3413 345/102 |
| 2013/0050559 | A1* | 2/2013 | Chen | G06F 3/042 348/335 |

* cited by examiner

*Primary Examiner* — Michael Faragalla
(74) *Attorney, Agent, or Firm* — Innovation Counsel LLP

(57) ABSTRACT

A display apparatus includes a display panel and a light source part. The display panel includes a first subpixel having a first color, a second subpixel having a second color and a transparent subpixel. The light source part provides a light to the display panel. The light source part includes a first light source generating a first light having a mixed color of the first primary color and the second primary color and a second light source generating a second light having a third primary color. At least one of the first and second light sources are repeatedly turned on and off.

37 Claims, 9 Drawing Sheets

DISPLAY APPARATUS AND METHOD OF DRIVING THE SAME

CROSS-REFERENCE TO RELATED APPLICATION

This application claims priority to Korean Patent Application No. 10-2012-0050512, filed on May 11, 2012, and all the benefits accruing therefrom under 35 U.S.C. §119, the contents of which application in its entirety is herein incorporated by reference.

BACKGROUND

1. Field of Disclosure

The present disclosure of invention relates to a display apparatus and a method of driving the display apparatus. More particularly, the present disclosure relates to a display apparatus configured for decreased power consumption and a method of driving the display apparatus.

2. Description of Related Technology

Generally, a liquid crystal display (LCD) apparatus includes a liquid crystal display panel displaying an image using a light transmittance attribute of an electrically orientatible liquid crystal and a light sourcing attribute of a light source module providing a light to the liquid crystal display panel. For example, the light source module may be a backlighting assembly that provides white light to a back side of the display panel.

The liquid crystal display panel typically includes a first substrate having an array of pixel electrodes and an array thin film transistors connected to the pixel electrodes as well as a spaced apart second substrate having a common electrode and a plurality of color filters. A liquid crystal material layer is interposed between the first and second substrates.

The light source module typically includes a plurality of light sources generating a white light. For example, the light sources may include at least one of a cold cathode fluorescent lamp (CCFL), an external electrode fluorescent lamp (EEFL), a flat fluorescent lamp (FFL), and a light emitting diode (LED).

As mentioned, in the typical case the light source generates a white light. Then one of the color filters to which the white light is selectively transmitted, passes a specific color filtered out from among the many colors encompassed by the white light. However, since energy is consumed to generate the many color components of the white light, when the white light is ultimately passed through a respective color filter, the energies of the other colors in white light are lost (or more correctly, converted into waste heat). Due to this inherent energy loss at the color filter layer of the system, the overall power consumption of the display apparatus is relatively large in comparison to the light that is ultimately output when a colored image is displayed.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

BRIEF SUMMARY

In accordance with the present disclosure of invention, rather than continuously outputting a white light, a backlighting system is configured to alternatingly produce over time, different parts of the white light spectrum (e.g., only red mixed with green in one subframe and then only blue in a second subframe) so as to thereby provide a display apparatus capable of decreased power consumption relative to the brightness of a colored image produced by that display apparatus.

The present disclosure of invention also provides a method of driving the display apparatus having the time-multiplexed production of different lights from its backlighting system.

In an exemplary embodiment of a display apparatus according to the present invention, the display apparatus includes a display panel and a light source part. The display panel includes a first subpixel having a first color, a second subpixel having a second color and a transparent subpixel. The light source part provides a light to the display panel. The light source part includes a first light source generating a first light having a mixed color of the first primary color and the second primary color and a second light source generating a second light having a third primary color. At least one of the first and second light sources are repeatedly turned on and off.

In an exemplary embodiment of a method of driving the display apparatus according to the present invention, the method includes setting grayscale data of a first subpixel having a first color, a second subpixel having a second color and a transparent subpixel, turning on a first light source generating a first light having a mixed color of the first color and the second color and turning on a second light source generating a second light having a third color.

In an exemplary embodiment of a display apparatus according to the present invention, the display apparatus includes a display panel and a light source part. The display panel includes a first subpixel having a first color, a second subpixel having a second color and a transparent subpixel. The light source part provides a light to the display panel. The light source part includes a first light source generating a first light which is a white light and a second light source generating a second light having a third color. At least one of the first and second light sources are repeatedly turned on and off.

In an exemplary embodiment of a method of driving the display apparatus according to the present invention, the method includes setting grayscale data of a first subpixel having a first color, a second subpixel having a second color and a transparent subpixel, turning on a first light source generating a first light which is a white light and turning on a second light source generating a second light having a third color.

According to the display apparatus and the method of driving the display apparatus, the light sources having different backlighting colors are repeatedly turned on and off so that a power consumption may be decreased when various parts of the backlighting spectrum are not needed.

BRIEF DESCRIPTION OF THE DRAWINGS

The above and other features and advantages of the present disclosure of invention will become more apparent by describing in detailed exemplary embodiments thereof with reference to the accompanying drawings, in which.

DETAILED DESCRIPTION

Hereinafter, exemplary embodiments in accordance with the present disclosure of invention will be described in further detail with reference to the accompanying drawings.

Figure 1:
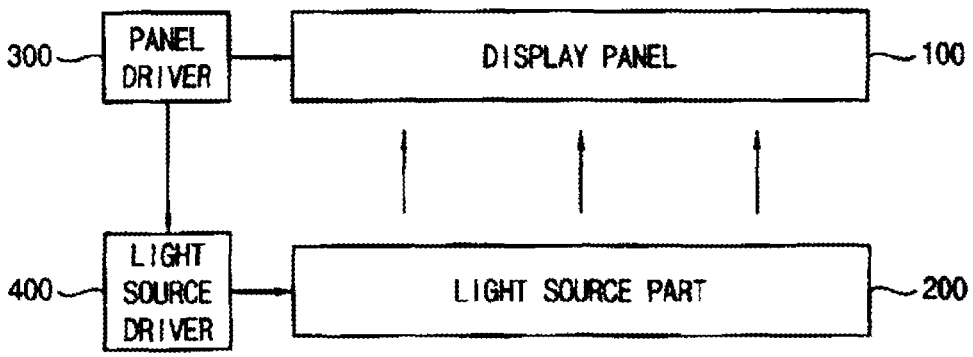
FIG. 1 is a block diagram illustrating a display apparatus according to a first exemplary embodiment of the present disclosure.
Figure 2:
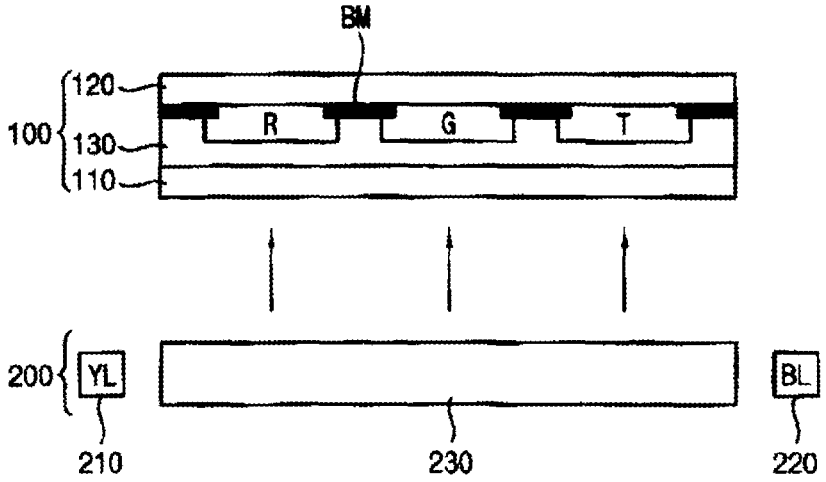
FIG. 2 is a cross-sectional view illustrating a display panel and a light source part of FIG. 1.
Figure 3A:
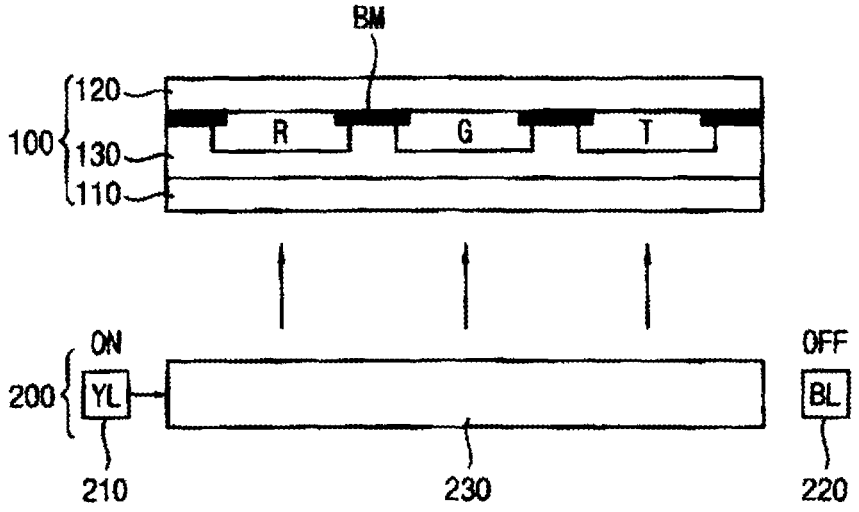
FIG. 3A is a cross-sectional view illustrating the display panel and the light source part of FIG. 1 in a first subframe.
Figure 3B:
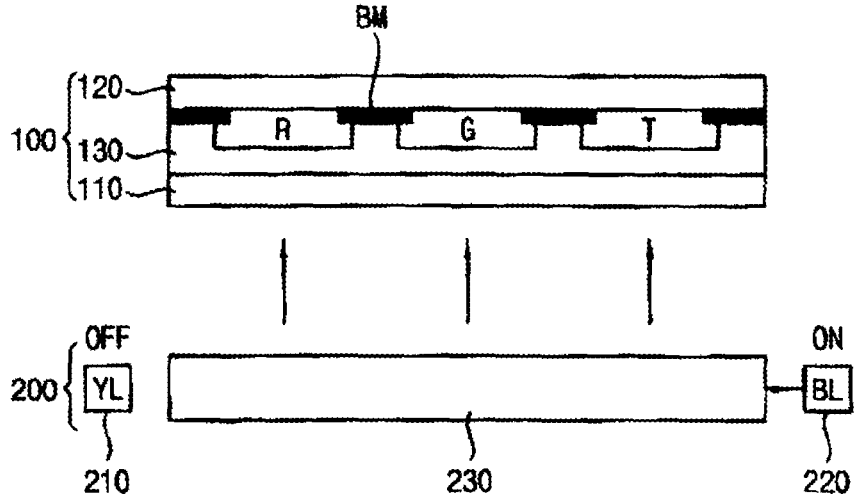
FIG. 3B is a cross-sectional view illustrating the display panel and the light source part of FIG. 1 in a second subframe.

FIG. 1 is a block diagram illustrating a display apparatus according to an exemplary embodiment at a schematic block diagram level. FIG. 2 is a cross-sectional view illustrating a display panel part and a light source part used in the system of FIG. 1. FIG. 3A is a cross-sectional view illustrating the display panel and the light source part of FIGS. 1-2 when in a first subframe mode. FIG. 3B is a cross-sectional view illustrating the display panel and the light source part of FIGS. 1-2 when in a second subframe mode. The cross-sectional views of FIGS. 2, 3A-3B are to be understood as exemplary and non-limiting particularly since a top view and shape of the sectioning line is not shown. In one embodiment, the top view of the repeat group (R, G, T) appears generally as two side-by-side rectangles of same shape and size with the R and the G subpixels being squares stacked one vertically above the other (with BM in between) to form the first rectangle while the T subpixel forms the entirety of the vertically elongated second rectangle and the sectioning line (not shown) cuts vertically down the first rectangle and then horizontally through the second rectangle (not shown) so as to produce the cross-sectional views of FIG. 2. Other top view and sectioning configurations are also possible and are within the contemplation of the present disclosure. Additionally, and as shall be detailed below, the light sources 210 and 220 do not need to be at opposed ends of the exemplary light guide plate (LGP) 230. They instead could be disposed at respective adjacent edges of the edge-lit LGP, which adjacent edges extend 90 degrees relative to one another. Other top view and light source disposing configurations are also possible and are within the contemplation of the present disclosure.

Referring collectively to FIGS. 1, 2, 3A and 3B, the corresponding display apparatus includes a display panel 100, a light source part 200, a panel driver 300 and a light source driver 400.

The display panel 100 includes selectively activatable pixels or subpixels that are selectively activated to display a desired image (e.g., a color image). The display panel 100 includes a first substrate 110, a spaced apart second substrate 120 and an interposed liquid crystal layer 130.

More specifically, the display panel 100 includes a display area populated by an area tessellating repeat group having first subpixel R configured to output only a first primary color (e.g., Red) at a respective first luminance level, a second subpixel G configured to output only a second primary color (e.g., Green) at a respective second luminance level and a third subpixel T (a.k.a. transparent subpixel T) configured to output any or all of components of a provided white light (if so provided) at a respective third luminance level. Although just one exemplary repeat group is illustrated, it is to be understood that the repeat group is repeated many times across the display area (DA) of the display panel 100.

The first substrate 110 may be a thin film transistor ("TFT") array substrate including a plurality of TFTs configured as a matrix interspersed with a corresponding matrix of transparent subpixel electrodes. The first substrate 110 may further include a plurality of gate lines extending in a first direction and a plurality of data lines extending in a second direction that is crossing with the first direction.

The second substrate 120 faces the first substrate 110. The second substrate 120 may be a color filters substrate including a plurality of different color filters and so-called, transparent windows or white light filters for the case of the transparent subpixels T. The second substrate may further include a transparent common electrode.

The first subpixel R may be so designated because it is overlapped by a red color filter (R) disposed on the second substrate 120. The second subpixel G may be so designated because it is overlapped by a green color filter (G) disposed on the second substrate 120. The transparent subpixel T may be so designated because it is overlapped by a not-color-absorbing (e.g., transparent filter T) disposed on the second substrate 120. For example, the transparent color filter may be a substantially empty space or filled with a substantially non-absorbing light-passing material. A light blocking pattern BM may be disposed between the color filters.

The liquid crystal layer 130 is disposed between the first and second substrates 110 and 120.

Although the color filters are disposed on the second substrate 120 in the present exemplary embodiment, the present disclosure of invention is not limited thereto. It is within the contemplation of the present disclosure to have color filters disposed in a same substrate as that which supports the pixel-electrodes.

The panel driver 300 is connected to the display panel 100 to drive the display panel 100 and to provide corresponding drive signals to the light source driver 400. The panel driver 300 may include a timing controller, a gate lines driver and a data lines driver (not shown).

The timing controller generates a first control signal to control a driving timing of the gate lines driver, and outputs the first control signal to the gate lines driver. The timing controller generates a second control signal to control a driving timing of the data lines driver, and outputs the second control signal to the data lines driver. The gate lines driver outputs respective gate line signals (e.g., row scanning signals) to the gate lines. The data lines driver outputs respective data signals (e.g., analog voltage signals) to the data lines.

By producing the respective data signals in synchronization with respective ones of the gate line signals, the panel driver 300 sets respective grayscale levels (passed luminance levels) for the corresponding first, second and transparent subpixels R, G and T of the respective repeat groups that populate the display area (DA).

The panel driver 300 also generates a light source control signal to control a driving timing of the light source driver 400, and outputs the light source control signal to the light source driver 400. The data lines and gate lines drive signals of the panel driver 300 may be synchronized with the light source control signals sent to the light source driver 400.

The light source part 200 includes a first light source 210 and a second light source 220 which may be independently energized to respective and independent power levels. The light source part 200 may further include a light guide plate (LGP) 230. The light source part 200 (which includes at least independently powered light sources 210 and 220 and the edge-lit LGP 230) can generate both a white light of selectable temperature and at other times, non-white lights formed by partial spectrums of the white light, where the light source part 200 provides these at respective times as backlighting to the display panel 100.

More specifically, the first and second light sources, 210 and 220 can generate a light having a selective mixture of independently activatable (and independently driven to respective luminances) colors such as, in the given example, a first color (e.g., Yellow) and a second color (e.g., Blue) which when appropriately combined can also produce a white light. Yet more specifically and in the first exemplary embodiment, the first color of Yellow (YL) is produced by mixing a first primary color which is red (R) and a second primary color which is green (G), whereby a balanced mixing of these first and second primary colors produces a yellow light (YL).

Additionally, in the first exemplary embodiment, the second light source 220 independently generates the third primary color, which in this case is blue so that the generated Blue Light (BL) may be mixed (e.g., temporally) with the generated Yellow Light (YL) to create a perception for the human visual system of a generated White Light (WL).

Although the first, second and third primary colors of the given example are respectively red (R), green (G) and blue (B), the present disclosure of invention is not limited thereto and it is within the contemplation of the disclosure to use other divisions of the visible light spectrum for producing both white light (WL) in one instance and, at one or more other instances (e.g., other subframe durations), independently powered lights of selected colors (e.g., red or green and/or yellow).

In the present exemplary embodiment, the first light source 210 may include a light emitting diode ("LED", or a combination of LEDs like Red and Green) which emits a yellow light (YL). The second light source 220 may include a LED which emits a blue light (BL). Alternatively, the first light source 210 may include a blue or UV LED and a yellow phosphor which is caused to fluoresce as yellow when driven by the blue or UV LED. The LEDs may be of an organic (OLED) type and/or of a semiconductive type.

The light guide plate 230 receives at respective edges thereof (not necessarily opposed edges) the generated Yellow Light (YL) of light source 210 and the generated Blue Light (BL) of light source 220 and redirects and guides these lights from the first and second light sources 210 and 220 disposed at its edges to the display panel 100 disposed above a top major surface of the LGP 230. While not shown, there may be additional optical processing plates or sheets between the LGP 230 and the display panel 100 such as diffusing and prismatic sheets.

In the present exemplary embodiment, the first light source 210 may be disposed adjacent to a first side edge of the light guide plate 230 and the second light source 220 may be disposed adjacent to a second side edge of the light guide plate 230 opposite to the first side edge of the light guide plate 230. However, as mentioned above, this is not a necessary configuration and many other configurations are within the contemplation of the present disclosure; such as for example having Red LEDs disposed at a first side edge of the light guide plate, having Green LEDs disposed at a second side edge of the light guide plate, having Blue LEDs disposed at a third side edge of the light guide plate, and having white light (WL) outputting LEDs disposed at a fourth side edge of the light guide plate. The light guide plate (LGP) 230 need not be rectangular and may have a variety of other polygonal shapes. Not all edges of the various possible polygonal shapes need to be light receiving ones (or only light receiving ones) and some can be light reflecting ones (e.g., mirror coated ones). The side edges of the light guide plate (LGP) 230 need not be at right angles to the top and/or bottom major surfaces of the LGP and they need not be straight edges. For example, they could be concave edges (not shown).

Although the light source part 200 is illustrated as being an edge-lit type of light source part including the light guide plate 230 and the first and second light sources 210 and 220 disposed at side edge portions of the light guide plate 230, the present disclosure of invention is not limited thereto. Alternatively, the light source part 200 may be of a directly backlighted type of light source part including a plurality of light sources disposed under the display panel 100 and corresponding to an entire area of the display panel 100. Alternatively, the light source part 200 may be of a hybrid type that includes a plurality of LGP strips or bars and direct backlighting lamps interposed between the LGP bars.

Although the exemplary display apparatus is a liquid crystal display (LCD) apparatus including the liquid crystal layer 130, the present disclosure of invention is not limited thereto. Alternatively, the display apparatus may be a hybrid organic light emitting diodes ("OLED") type of display apparatus including for example OLEDs that are selectively energizeable to produce respective Red and Green output lights at the positions where the R and G color filters are shown in FIG. 2 while the Transparent (T) color filter is driven by additional light sources (e.g., 210 and 220) to produce therefrom a Blue, a Yellow and/or white light (WL) as deemed appropriate by drive signals provided to the light source driver circuit 400.

As mentioned, the light source driver 400 is connected to and selectively drives the light source part 200. In one embodiment, the light source driver 400 repeatedly turns on and off in respective subframe durations, at least one of the first and second light sources 210 and 220 and for example with respective Pulse Width Modulation (PWM) ratios.

More specifically, in one exemplary embodiment, the light source driver 400 alternately turns on the first light source 210 while the second light source 220 is turned off and turns on the second light source 220 while the first light source 210 is turned off. For example, during a first subframe, the first light source 210 is turned on (continuously or pulsed) and the second light source 220 is turned off. In contrast, during a second subframe, the first light source 210 is turned off and the second light source 220 is turned on (continuously or pulsed).

Duration of the first subframe may be substantially equal to duration of the second frame. Alternatively, the duration of the first subframe may be different from the duration of the second frame.

For example, the display panel 100 may display the images at a frame rate of 120 Hz (hertz). The light source driver 400 may alternately turn on the first and second light sources 210 and 220 at a frequency of 120 Hz.

For example, the display panel 100 may display a three-dimensional ("3D") image having left and right eye image components. The display panel 100 may in that case alternately display a left image and a right image at a frequency of 120 Hz. In one embodiment, the display panel 100 displays two left images in a row and then two right images in a row. As a result, the display panel 100 displays the images at a frame rate of 240 Hz. The light source driver 400 may alternately turn on the first and second light sources 210 and 220 at a frequency of 240 Hz.

The panel driver 300 may perform a subpixel rendering (SPR) operation so as to set the respective grayscale levels of the first subpixel R, the second subpixel G and the transparent subpixel T in each respective repeat group (only one shown).

Herein, A is a grayscale level of the first primary color, B is a grayscale level of the second primary color, C is a grayscale level of the third primary color and min(A,B) is a minimum value between A and B. Hereinafter, a first subpixel rendering method in accordance with the present disclosure is explained.

During the first subframe, when the first light source 210 is turned on and the second 220 is continuously off, the panel driver 300 may set the grayscale data of the first subpixel R to A-min(A,B), the grayscale data of the second subpixel G to B-min(A,B) and the grayscale data of the transparent subpixel T to min(A,B)—where the hyphens in this paragraph represent minus signs.

During the second subframe, when the second light source 220 is turned on and the first 210 is continuously off, the panel driver 300 may set the grayscale data of the transparent subpixel T to C. Thus, due to temporal addition performed by the human visual system, the combination of the two subframe durations causes the combined output through the R color filter to be A-min(A,B) times the Yellow Light (YL) dimming factor; the combined output through the G color filter to be B-min(A,B) times the Yellow Light (YL) dimming factor; and the combined output through the T color filter to be min(A,B) times the Yellow Light (YL) dimming factor plus C times the Blue Light (BL) dimming factor.

Next in the following, A is again a grayscale level of the first primary color, B is a grayscale of the second primary color and C is a grayscale of the third primary color. Hereinafter, a second subpixel rendering method is explained.

During the first subframe, the panel driver 300 may set the grayscale data of the first subpixel R to A, the grayscale data of the second subpixel G to B and the grayscale data of the transparent subpixel T to A+B.

During the second subframe, the panel driver 300 may set the grayscale data of the transparent subpixel T to 2° C. (two times C).

In the second subpixel rendering method, the display panel 100 may have a higher luminance comparing to that of the first subpixel rendering method.

According to the present exemplary embodiment, the display panel 100 includes red, green and transparent subpixels R, G and T and the light source part 200 includes yellow and blue light sources YL and BL which are repeatedly turned on and off so that a power consumption of the display apparatus may be decreased because Red and Green (but not Blue) color components of the frame are output through the T color filter as well as through the R and G color filters during the first subframe duration while not wasting energy to drive the R and G color filters with a non-passable Blue Light (BL) during the first subframe duration. On the other hand, during the second subframe duration, a white light (WL) may be produced by the LPG 230 or a Bluish Light (mostly BL, but some YL as well) may be produced by the LPG 230 or just a Blue Light (BL) may be produced by the LPG 230 where the latter Blue Light (BL) is pushed just through the T color filter. Accordingly, the efficiency of outputting the Red and Green color components of the frame is improved because energy is not wasted producing a non-passable Blue Light (BL) during the first subframe duration for passage through the R and G color filters during the first subframe duration.

Figure 4:
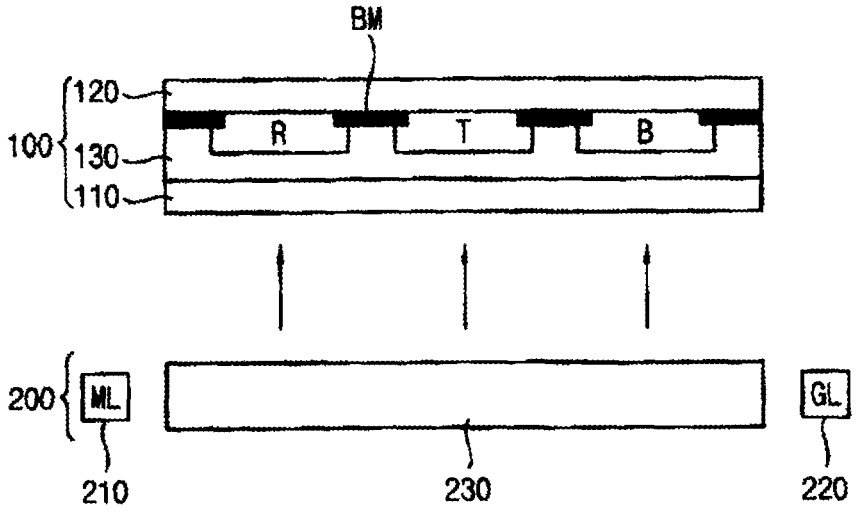
FIG. 4 is a cross-sectional view illustrating a display panel and a light source part of a display apparatus according to a second exemplary embodiment.

FIG. 4 is a cross-sectional view illustrating a display panel and a light source part of a display apparatus according to a second exemplary embodiment in accordance with the present disclosure.

The display apparatus and the method of driving the same according to the second exemplary embodiment are substantially the same as the display apparatus and the method of driving the same in FIGS. 1 to 3B except that a first subpixel has a red (R) color filter, the second subpixel has a Transparent (T) color filter, the third color filter has a blue (B) color filter, the first light source 210 is a magenta light (ML) source and the second light source 220 is a green light (GL) source. Thus, the same reference numerals will be used to refer to the same or like parts as those described in FIGS. 1 to 3B and any repetitive explanation concerning the above elements will be omitted.

Referring to FIGS. 1 and 4, the display apparatus of that second embodiment includes a display panel 100, a light source part 200, a panel driver 300 and a light source driver 400.

The display panel 100 includes a first subpixel denoted as R and configured to output a corresponding first primary color (R), a second subpixel denoted as T and configured to output the colored or white light (WL) supplied thereto from the light source part 200 and a third subpixel denoted as B and configured to output a second primary color (B).

More specifically, in the present exemplary embodiment, the first primary color is red. The first subpixel R is a red subpixel. The second primary color is blue. The second subpixel B is a blue subpixel.

The first subpixel R may be defined by a red color filter disposed on the second substrate 120. The second subpixel B may be defined by a blue color filter disposed on the second substrate 120. The transparent subpixel T may be defined by a transparent color filter disposed on the second substrate 120. For example, the transparent color filter may be a substantially empty space at which no color-absorbing filter is disposed. A light blocking pattern BM may be disposed between the color filters.

The panel driver 300 sets grayscale data of the first, second and third subpixels R, T, B.

The light source part 200 includes a first light source 210 and a second light source 220. The light source part 200 may further include a light guide plate 230. The light source part 200 generates a light and provides the light to the display panel 100.

The first light source 210 generates a light having a mixed color of the first primary color and the second primary color. In the present exemplary embodiment, the first primary color is red, the second primary color is blue, and the mixed color of the first and second primary colors is magenta (M).

The second light source 220 generates a light having a third primary color. The third primary color may be green (G).

The light source driver 400 is connected to the light source part 200. The light source driver 400 drives the light source part 200. In the present exemplary embodiment, the light source driver 400 may alternately turn on one but not the other of the first and second light sources 210 and 220 in respective first and second subframe durations. For example, during a first subframe, the first light source 210 is turned on and the second light source 220 is turned off. In contrast, during a second subframe, the first light source 210 is turned off and the second light source 220 is turned on.

According to the present exemplary embodiment, the display panel 100 includes red, blue and transparent subpixels R, B and T and the light source part 200 includes magenta and green light sources ML and GL which are repeatedly turned on and off so that a power consumption of the display apparatus may decreased because backlighting energy is not wasted outputting a Green light (GL) during a Red and Blue only, passing subframe where only the magenta light source (ML) is turned on.

Figure 5:
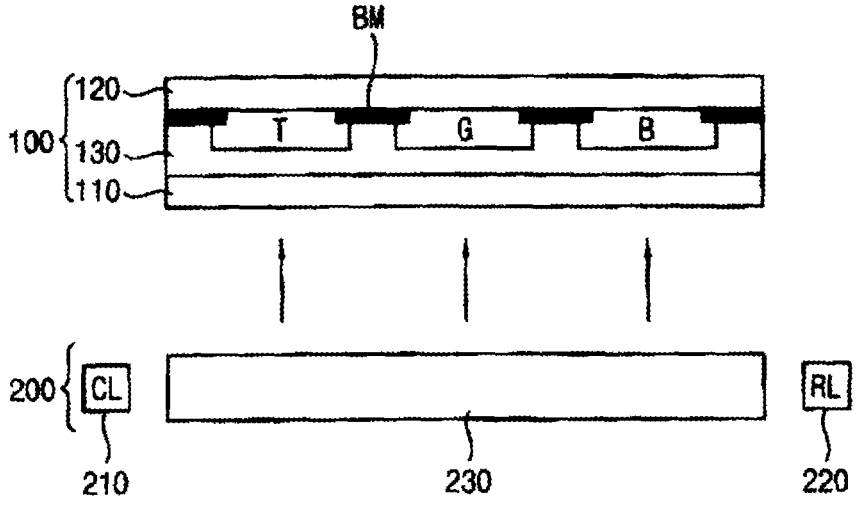
FIG. 5 is a cross-sectional view illustrating a display panel and a light source part of a display apparatus according to another exemplary embodiment.

FIG. 5 is a cross-sectional view illustrating a display panel and a light source part of a display apparatus according to a third exemplary embodiment.

The display apparatus and the method of driving the same according to the present exemplary embodiment are substantially the same as the display apparatus and the method of driving the same in FIGS. 1 to 3B except that a first subpixel is a green subpixel, a second subpixel is a blue subpixel, a third subpixel is the Transparent (T) subpixel, a first light source is a cyan light (CL) source and a second light source is a red light (RL) source. Thus, the same reference numerals will be used to refer to the same or like parts as those described in FIGS. 1 to 3B and any repetitive explanation concerning the above elements will be omitted.

Referring to the embodiment of FIGS. 1 and 5, the display apparatus includes a display panel 100, a light source part 200, a panel driver 300 and a light source driver 400.

The display panel 100 includes a first subpixel R having a first primary color, a second subpixel B having a second primary color and a transparent subpixel T.

In the present exemplary embodiment, the first primary color is green. The first subpixel G is a green subpixel. The second primary color is blue. The second subpixel B is a blue subpixel.

The first subpixel G may be defined by a green color filter disposed on the second substrate 120. The second subpixel B may be defined by a blue color filter disposed on the second substrate 120. The transparent subpixel T may be defined by a transparent color filter disposed on the second substrate 120. For example, the transparent color filter may be a substantially empty space at which any color filter is not disposed. A light blocking pattern BM may be disposed between the color filters.

The panel driver 300 sets grayscale data of the first, second and transparent subpixels G, B and T.

The light source part 200 includes a first light source 210 and a second light source 220. The light source part 200 may further include a light guide plate 230. The light source part 200 generates a light and provides the light to the display panel 100.

The first light source 210 generates a light having a mixed color of the first primary color and the second primary color. In the present exemplary embodiment, the first primary color is green, the second primary color is blue, and the mixed color of the first and second primary colors is cyan (C).

The second light source 220 generates a light having a third primary color. The third primary color may be red (R).

The light source driver 400 is connected to the light source part 200. The light source driver 400 drives the light source part 200. In the present exemplary embodiment, the light source driver 400 may alternately turn on the first and second light sources 210 and 220. For example, during a first subframe, the first light source 210 is turned on and the second light source 220 is turned off. In contrast, during a second subframe, the first light source 210 is turned off and the second light source 220 is turned on.

According to the present exemplary embodiment, the display panel 100 includes green, blue and transparent subpixels G, B and T and the light source part 200 includes respective cyan and red light sources, CL and RL which are repeatedly turned on and off so that a power consumption of the display apparatus may be decreased.

Figure 6:
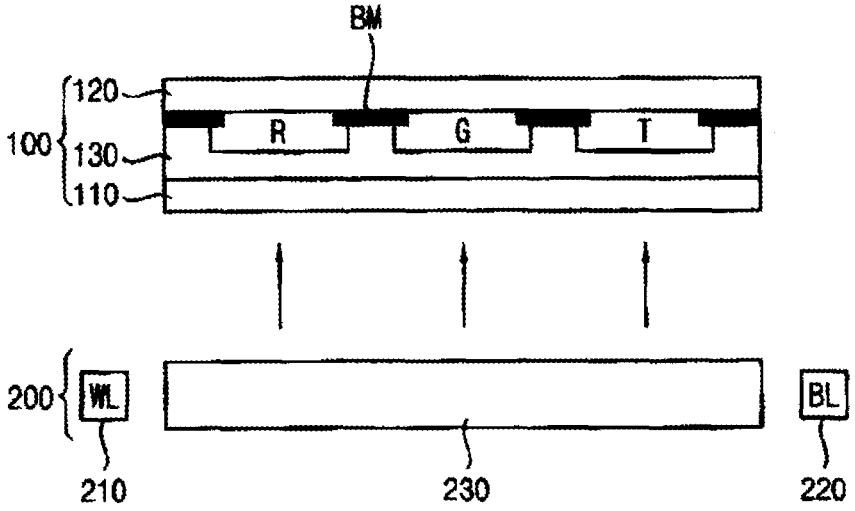
FIG. 6 is a cross-sectional view illustrating a display panel and a light source part of a display apparatus according to an exemplary embodiment.

FIG. 6 is a cross-sectional view illustrating a display panel and a light source part of a display apparatus according to a further exemplary embodiment in accordance with the present disclosure.

The display apparatus and the method of driving the same according to the present exemplary embodiment are substantially the same as the display apparatus and the method of driving the same in FIGS. 1 to 3B except that a first light source is a white light (WL) source. Thus, the same reference numerals will be used to refer to the same or like parts as those described in FIGS. 1 to 3B and any repetitive explanation concerning the above elements will be omitted.

Referring to the embodiment of FIGS. 1 and 6, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In the present exemplary embodiment, the first primary color is red. The first subpixel R is a red subpixel. The second primary color is green. The second subpixel G is a green subpixel.

The first subpixel R may be defined by a red color filter disposed on the second substrate 120. The second subpixel G may be defined by a green color filter disposed on the second substrate 120. The transparent subpixel T may be defined by a transparent color filter disposed on the second substrate 120. For example, the transparent color filter may be a substantially empty space at which any color filter is not disposed. A light blocking pattern BM may be disposed between the color filters.

The panel driver 300 sets grayscale data of the first, second and transparent subpixels R, G and T.

The light source part 200 includes a first light source 210 and a second light source 220. The light source part 200 may further include a light guide plate 230. The light source part 200 generates a light and provides the light to the display panel 100.

The first light source 210 generates a white light (e.g., produced by a mixture of R, G and B lights). The second light source 220 generates a light having a third primary color. The third primary color may be blue.

The light source driver 400 is connected to the light source part 200. The light source driver 400 drives the light source part 200. In the present exemplary embodiment, the light source driver 400 may alternately turn on the first and second light sources 210 and 220. For example, during a first subframe, the first light source 210 is turned on and the second light source 220 is turned off. In contrast, during a second subframe, the first light source 210 is turned off and the second light source 220 is turned on.

The panel driver 300 performs a subpixel rendering operation on supplied image data (e.g., RGB input data—not shown) to set respective grayscale digitized level for each of the first subpixel R, the second subpixel G and the transparent subpixel T in respective ones of plural subframe durations.

Herein, A is a grayscale of the first primary color, B is a grayscale of the second primary color, C is a grayscale of the third primary color and min(A,B,C) is a minimum value among A, B and C. Hereinafter, a first subpixel rendering method is explained.

During the first subframe, when only the first light source 210 is turned on, the panel driver 300 may set the grayscale data of the first subpixel R to A-min(A,B,C), the grayscale data of the second subpixel G to B-min(A,B,C) and the grayscale data of the transparent subpixel T to min(A,B,C).

During the second subframe, when only the second light source 220 is turned on, the panel driver 300 may set the grayscale data of the transparent subpixel T to C-min(A,B,C).

Herein, A is a grayscale of the first primary color, B is a grayscale of the second primary color and C is a grayscale of the third primary color. Hereinafter, a second subpixel rendering method is explained.

During the first subframe, the panel driver 300 may set the grayscale data of the first subpixel R to A, the grayscale data of the second subpixel G to B and the grayscale data of the transparent subpixel T to A+B+C.

During the second subframe, the panel driver 300 may set the grayscale data of the transparent subpixel T to C.

In the second subpixel rendering method, the display panel 100 may have a higher luminance comparing to the first subpixel rendering method.

According to the present exemplary embodiment, the display panel 100 includes red, green and transparent subpixels R, G and T and the light source part 200 includes white and blue light sources WL and BL which are repeatedly turned on and off so that a power consumption of the display apparatus may be decreased.

Figure 7:
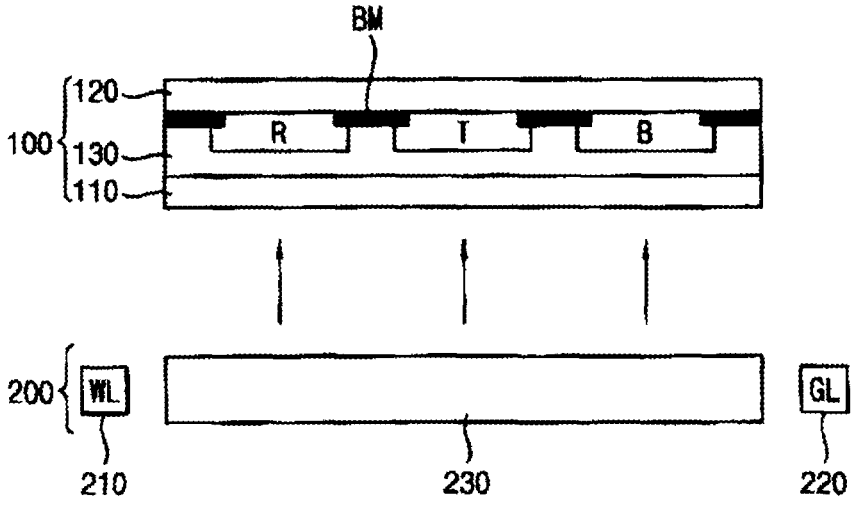
FIG. 7 is a cross-sectional view illustrating a display panel and a light source part of a display apparatus according to an exemplary embodiment.

FIG. 7 is a cross-sectional view illustrating a display panel and a light source part of a display apparatus according to yet another exemplary embodiment.

The display apparatus and the method of driving the same according to the present exemplary embodiment are substantially the same as the display apparatus and the method of driving the same in FIG. 4 except that a first light source is a white light source. Thus, the same reference numerals will be used to refer to the same or like parts as those described in FIG. 4 and any repetitive explanation concerning the above elements will be omitted.

Referring to the embodiment of FIGS. 1 and 7, the display apparatus includes a display panel 100, a light source part 200, a panel driver 300 and a light source driver 400.

The display panel 100 includes a first subpixel R having a first primary color, a second subpixel B having a second primary color and a transparent subpixel T.

In the present exemplary embodiment, the first primary color is red. The first subpixel R is a red subpixel. The second primary color is blue. The second subpixel B is a blue subpixel.

The first subpixel R may be defined by a red color filter disposed on the second substrate 120. The second subpixel B may be defined by a blue color filter disposed on the second substrate 120. The transparent subpixel T may be defined by a transparent color filter disposed on the second substrate 120. For example, the transparent color filter may be a substantially empty space at which any color filter is not disposed. A light blocking pattern BM may be disposed between the color filters.

The panel driver 300 sets respective grayscale data levels of the first, second and transparent subpixels R, B and T for respective subframe durations.

The light source part 200 includes a first light source 210 and a second light source 220. The light source part 200 may further include a light guide plate 230. The light source part 200 generates a light and provides the light to the display panel 100.

The first light source 210 generates a white light (WL). The second light source 220 generates a light having a third primary color. The third primary color may be green (GL).

The light source driver 400 is connected to the light source part 200. The light source driver 400 drives the light source part 200. In the present exemplary embodiment, the light source driver 400 may alternately turn on the first and second light sources 210 and 220. For example, during a first subframe, the first light source 210 is turned on and the second light source 220 is turned off. In contrast, during a second subframe, the first light source 210 is turned off and the second light source 220 is turned on.

According to the present exemplary embodiment, the display panel 100 includes red, blue and transparent subpixels R, B and T and the light source part 200 includes white and green light sources WL and GL which are repeatedly turned on and off so that a power consumption of the display apparatus may be decreased when compared to a conventional RGB display that is driven by a continuously turned on, white light (WL) backlighting means (not shown).

Figure 8:
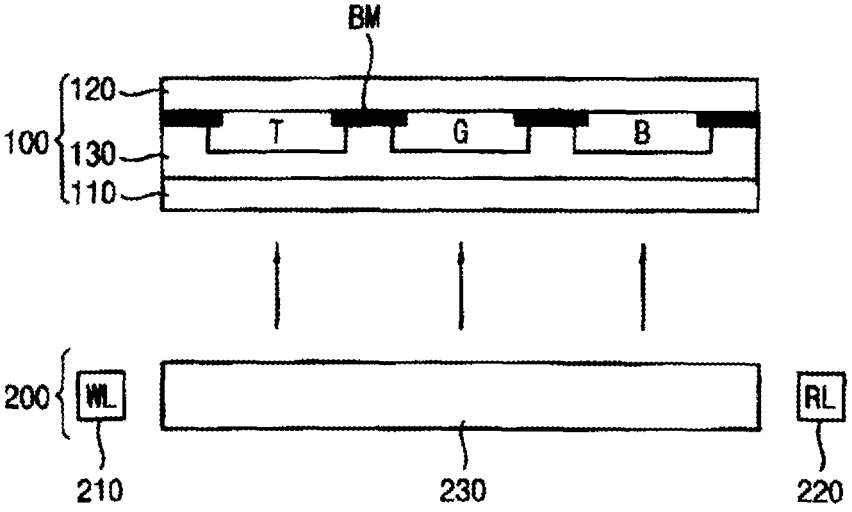
FIG. 8 is a cross-sectional view illustrating a display panel and a light source part of a display apparatus according to an exemplary embodiment.

FIG. 8 is a cross-sectional view illustrating a display panel and a light source part of a display apparatus according to another exemplary embodiment.

The display apparatus and the method of driving the same according to the present exemplary embodiment are substantially the same as the display apparatus and the method of driving the same in FIG. 5 except that a first light source is a white light source. Thus, the same reference numerals will be used to refer to the same or like parts as those described in FIG. 5 and any repetitive explanation concerning the above elements will be omitted.

Referring to the embodiment of FIGS. 1 and 8, the display apparatus includes a display panel 100, a light source part 200, a panel driver 300 and a light source driver 400.

The display panel 100 includes a first subpixel G having a first primary color, a second subpixel B having a second primary color and a transparent subpixel T.

In the present exemplary embodiment, the first primary color is green. The first subpixel G is a green subpixel. The second primary color is blue. The second subpixel B is a blue subpixel.

The first subpixel G may be defined by a green color filter disposed on the second substrate 120. The second subpixel B may be defined by a blue color filter disposed on the second substrate 120. The transparent subpixel T may be defined by a transparent color filter disposed on the second substrate 120. For example, the transparent color filter may be a substantially empty space at which any color filter is not disposed. A light blocking pattern BM may be disposed between the color filters.

The panel driver 300 sets respective grayscale data levels of the first, second and transparent subpixels G, B and T during respective ones of plural subframe durations.

The light source part 200 includes a first light source 210 and a second light source 220. The light source part 200 may further include a light guide plate 230. The light source part 200 generates a light and provides the light to the display panel 100.

The first light source 210 generates a white light (WL). The second light source 220 generates a light having a third primary color. The third primary color may be red (RL).

The light source driver 400 is connected to the light source part 200. The light source driver 400 drives the light source part 200. In the present exemplary embodiment, the light source driver 400 may alternately turn on the first and second light sources 210 and 220. For example, during a first subframe, only the first light source 210 is turned on and the second light source 220 is turned off. In contrast, during a second subframe, only the first light source 210 is turned off and the second light source 220 is turned on.

According to the present exemplary embodiment, the display panel 100 includes green, blue and transparent subpixels G, B and T and the light source part 200 includes white and red light sources WL and RL which are repeatedly turned on and off so that a power consumption of the display apparatus may be decreased.

Figure 9A:
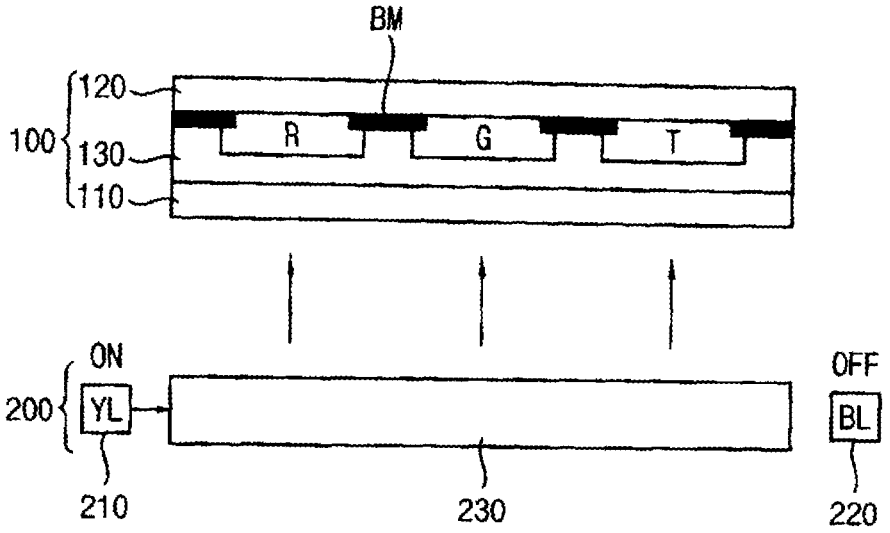
FIG. 9A is a cross-sectional view illustrating a display panel and a light source part of a display apparatus according to an exemplary embodiment in a first subframe.
Figure 9B:
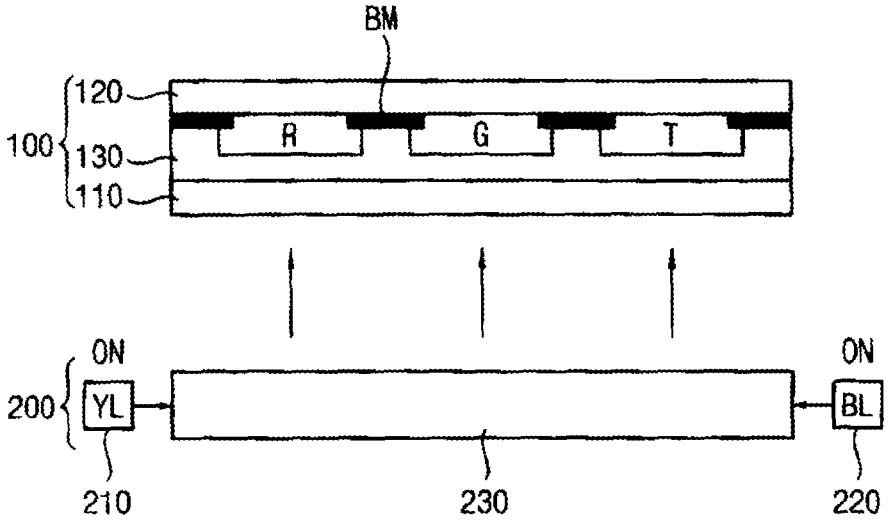
FIG. 9B is a cross-sectional view illustrating the display panel and the light source part of FIG. 9A in a second subframe.

FIG. 9A is a cross-sectional view illustrating a display panel and a light source part of a display apparatus according to an exemplary embodiment of the present disclosure in a first subframe. FIG. 9B is a cross-sectional view illustrating the display panel and the light source part of FIG. 9A in a following second subframe.

The display apparatus and the method of driving the same according to the present exemplary embodiment are substantially the same as the display apparatus and the method of driving the same in FIGS. 1 to 3B except that a first light source and a second light source are both turned on (not necessarily to same luminance levels, and each can be driven by a digital PWM method as an alternative to an analog and continuously on method) during a second subframe. Thus, the same reference numerals will be used to refer to the same or like parts as those described in FIGS. 1 to 3B and any repetitive explanation concerning the above elements will be omitted.

Referring to FIGS. 1, 2, 9A and 9B, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In the present exemplary embodiment, the first primary color is red. The first subpixel R is a red subpixel. The second primary color is green. The second subpixel G is a green subpixel. Alternatively, the first primary color may be red. The first subpixel may be a red subpixel. The second primary color may be blue. The second subpixel is a blue subpixel. Alternatively, the first primary color may be green. The first subpixel may be a green subpixel. The second primary color may be blue. The second subpixel is a blue subpixel.

The first subpixel R may be defined by a red color filter disposed on the second substrate 120. The second subpixel G may be defined by a green color filter disposed on the second substrate 120. The transparent subpixel T may be defined by a transparent color filter disposed on the second substrate 120. For example, the transparent color filter may be a substantially empty space at which any color filter is not disposed. A light blocking pattern BM may be disposed between the color filters.

The panel driver 300 sets grayscale data of the first, second and transparent subpixels R, G and T.

The light source part 200 includes a first light source 210 and a second light source 220. The light source part 200 may further include a light guide plate 230. The light source part 200 generates a light and provides the light to the display panel 100.

The first light source 210 generates a light having a mixed color of the first primary color and the second primary color. In the present exemplary embodiment, the first primary color is red, the second primary color is green, and the mixed color of the first and second primary colors is yellow (YL). Alternatively, the mixed color of the first and second primary colors may be magenta (ML, not shown). Alternatively, the mixed color of the first and second primary colors may be cyan (CL, not shown). Alternatively, the first light source 210 may generate a white light (WL, not shown). The second light source 220 generates a light having a third primary color (where in FIG. 8 such is illustrated as being a BL source but depending on the mixed color of the first and second primary colors produced by the first light source 210, it can be other than Blue).

The light source driver 400 is connected to the light source part 200. The light source driver 400 drives the light source part 200. The light source driver 400 repeatedly turns on and off at least one of the first and second light sources 210 and 220.

In the present exemplary embodiment, the first light source 210 may be continuously turned on. In contrast, the second light source 220 may be repeatedly turned on and off.

In the present exemplary embodiment, during a first subframe, only the first light source 210 is turned on and the second light source 220 is turned off. During a second subframe, both the first light source 210 and the second light source 220 are turned on.

The panel driver 300 operates a subpixel rendering function to thereby set respective grayscale data levels of the first subpixel R, the second subpixel G and the transparent subpixel T.

For example, when the display panel 100 represents a white grayscale of 100 grayscales, during the first subframe, the panel driver 300 may set a grayscale of the first primary color to 20 grayscales and a grayscale of the second primary color to 20 grayscales. The first light source 210 may generate the mixed light corresponding to 20 grayscales and the transparent subpixel T may fully transmit the mixed light from the first light source 210.

During the second subframe, the panel driver 300 may set the grayscale of the first primary color to 30 grayscales and the grayscale of the second primary color to 30 grayscales. The first light source 210 may generate the mixed light corresponding to 30 grayscales, the second light source 220 may generate the light of the third primary color corresponding to 100 grayscales and the transparent subpixel T may fully transmit the light from the turned combination of both of the first and second light sources 210 and 220.

Although 20 grayscales in the first subframe and 30 grayscales in the second subframe are exemplified in the present exemplary embodiment, the grayscales in the first and second subframes are limited thereto. The grayscales in the first and second subframes may be set such that a mixed image represents a desirable white grayscale.

According to the present exemplary embodiment, the display panel 100 includes red, green and transparent subpixels R, G and T and the light source part 200 includes a blue light source BL which is repeatedly turned on and off so that a power consumption of the display apparatus may decrease.

Figure 10A:
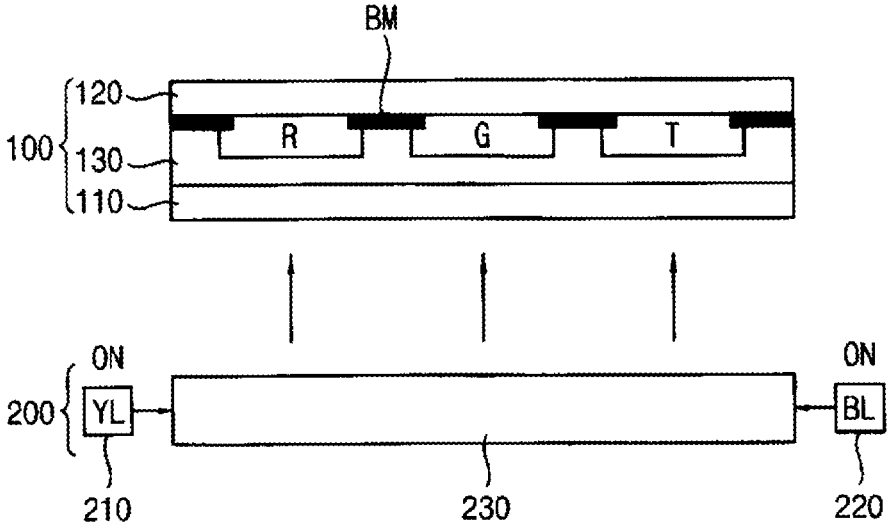
FIG. 10A is a cross-sectional view illustrating a display panel and a light source part of a display apparatus according to another exemplary embodiment in a first subframe.
Figure 10B:
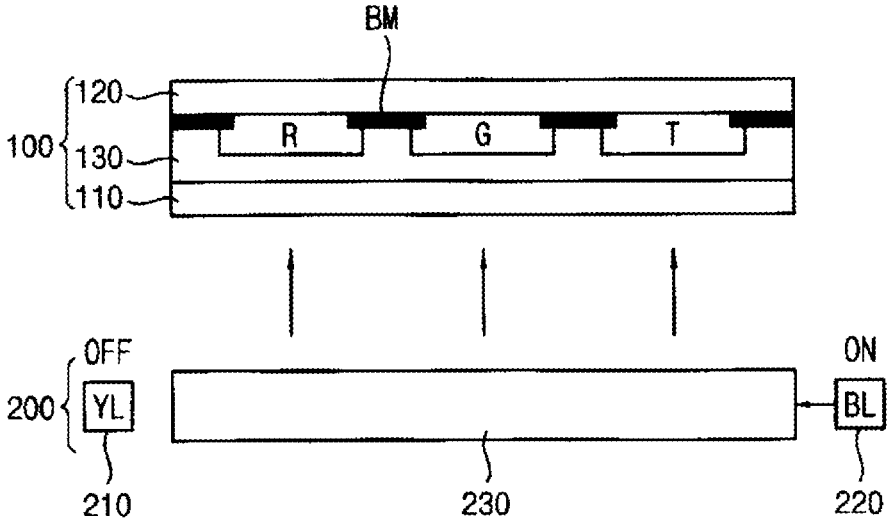
FIG. 10B is a cross-sectional view illustrating the display panel and the light source part of FIG. 10A in a second subframe.

FIG. 10A is a cross-sectional view illustrating a display panel and a light source part of a display apparatus according to an exemplary embodiment of the present disclosure of invention in a first subframe. FIG. 10B is a cross-sectional view illustrating the display panel and the light source part of FIG. 10A in a second subframe.

The display apparatus and the method of driving the same according to the present exemplary embodiment are substantially the same as the display apparatus and the method of driving the same in FIGS. 1 to 3B except that both of the first light source and the second light source are turned on during a first subframe. Thus, the same reference numerals will be used to refer to the same or like parts as those described in FIGS. 1 to 3B and any repetitive explanation concerning the above elements will be omitted.

Referring to the embodiment FIGS. 1, 10A and 10B, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In the present exemplary embodiment, the first primary color is red. The first subpixel R is a red subpixel. The second primary color is green. The second subpixel G is a green subpixel. Alternatively, the first primary color may be red. The first subpixel may be a red subpixel. The second primary color may be blue. The second subpixel is a blue subpixel. Alternatively, the first primary color may be green. The first subpixel may be a green subpixel. The second primary color may be blue. The second subpixel is a blue subpixel.

The first subpixel R may be defined by a red color filter disposed on the second substrate 120. The second subpixel G may be defined by a green color filter disposed on the second substrate 120. The transparent subpixel T may be defined by a transparent color filter disposed on the second substrate 120. For example, the transparent color filter may be a substantially empty space at which any color filter is not disposed. A light blocking pattern BM may be disposed between the color filters.

The panel driver 300 sets grayscale data of the first, second and transparent subpixels R, G and T.

The light source part 200 includes a first light source 210 and a second light source 220. The light source part 200 may further include a light guide plate 230. The light source part 200 generates a light and provides the light to the display panel 100.

The first light source 210 generates a light having a mixed color of the first primary color and the second primary color. In the present exemplary embodiment, the first primary color is red, the second primary color is green, and the mixed color of the first and second primary colors is yellow. Alternatively, the mixed color of the first and second primary colors may be magenta. Alternatively, the mixed color of the first and second primary colors may be cyan. Alternatively, the first light source 210 may generate a white light. The second light source 220 generates a light having a third primary color.

The light source driver 400 is connected to the light source part 200. The light source driver 400 drives the light source part 200. The light source driver 400 repeatedly turns on and off at least one of the first and second light sources 210 and 220.

In the present exemplary embodiment, the second light source 220 may be turned on in both of the first and second subframes. In contrast, the first light source 210 may be turned off in the second subframe.

In the present exemplary embodiment, during a first subframe, the first light source 210 and the second light source 220 are turned on. During a second subframe, the first light source 210 is turned off and only the second light source 220 is turned on.

The panel driver 300 operates subpixel rendering to set grayscale data of the first subpixel R, the second subpixel G and the transparent subpixel T.

For example, when the display panel 100 represents a white grayscale of 100 grayscales, during the first subframe, the panel driver 300 may set a grayscale of the first primary color to 50 grayscales and a grayscale of the second primary color to 50 grayscales. The first light source 210 may generate the mixed light corresponding to 50 grayscales, the second light source 220 may generate the light of the third primary color corresponding to 50 grayscales and the transparent subpixel T may fully transmit the light from the first and second light sources 210 and 220.

During the second subframe, the panel driver 300 may set the grayscale of the first primary color to 0 grayscale and the grayscale of the second primary color to 0 grayscale. The second light source 220 may generate the mixed light corresponding to 50 grayscales and the transparent subpixel T may fully transmit the light from the second light source 220.

According to the present exemplary embodiment, the display panel 100 includes red, green and transparent subpixels R, G and T and the light source part 200 includes a yellow light source YL which is repeatedly turned on and off so that a power consumption of the display apparatus may be decreased due to a purely white light (WL) not needing to be continuously turned on.

Figure 11:
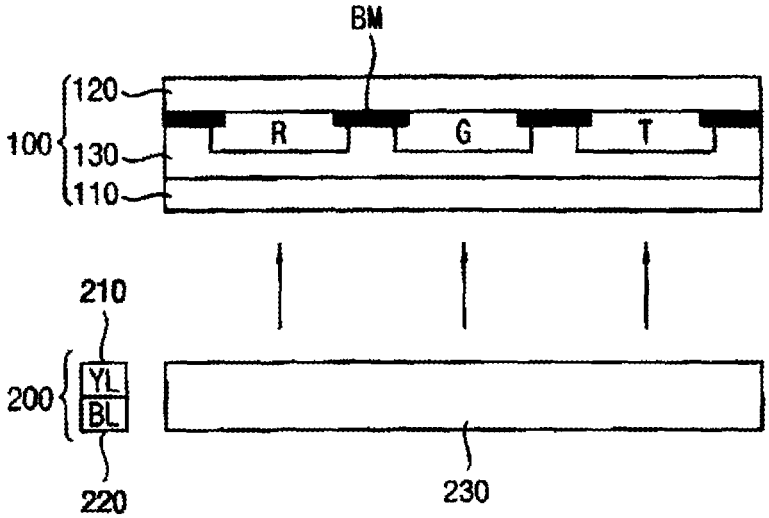
FIG. 11 is a cross-sectional view illustrating a display panel and a light source part of a display apparatus according to an exemplary embodiment.
Figure 12:
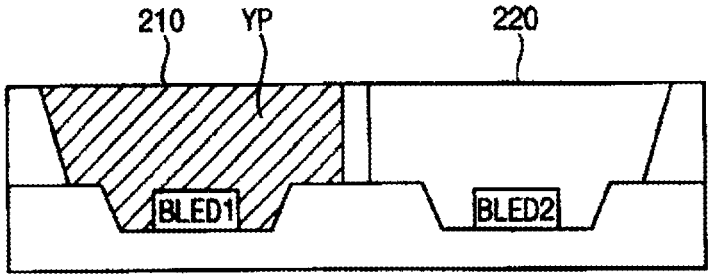
FIG. 12 is a cross-sectional view illustrating first and second light sources of FIG. 11.

FIG. 11 is a cross-sectional view illustrating a display panel and a light source part of a display apparatus according to an exemplary embodiment of the present disclosure of invention. FIG. 12 is a cross-sectional view illustrating one way in which the first and second light sources of FIG. 11 may be implemented.

The display apparatus and the method of driving the same according to the present exemplary embodiment are substantially the same as the display apparatus and the method of driving the same in FIGS. 1 to 3B except for the configuration of the light source part 200. Thus, the same reference numerals will be used to refer to the same or like parts as those described in FIGS. 1 to 3B and any repetitive explanation concerning the above elements will be omitted.

Referring to the embodiment of FIGS. 1 and 11, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In the present exemplary embodiment, the first primary color is red. The first subpixel R is a red subpixel. The second primary color is green. The second subpixel G is a green subpixel. Alternatively, the first primary color may be red. The first subpixel may be a red subpixel. The second primary color may be blue. The second subpixel is a blue subpixel. Alternatively, the first primary color may be green. The first subpixel may be a green subpixel. The second primary color may be blue. The second subpixel is a blue subpixel.

The light source part 200 includes a first light source 210 and a second light source 220 disposed adjacent to the first light source. The light source part 200 may further include a light guide plate 230. The light source part 200 generates a light and provides the light to the display panel 100.

The first light source 210 generates a light equivalent to having a mixed color of the first primary color and the second primary color. In the present exemplary embodiment, the first primary color is red, the second primary color is green, and the mixed color of the first and second primary colors is yellow. Alternatively, the mixed color of the first and second primary colors may be magenta. Alternatively, the mixed color of the first and second primary colors may be cyan. Alternatively, the first light source 210 may generate the white color. The second light source 220 generates a light having a third primary color. The third primary color may be blue (BL).

In the present exemplary embodiment, the first light source 210 and the second light source 220 may be formed in a package disposed adjacent to a shared side edge of the LGP 230. In the exemplary embodiment of FIG. 12, the package includes LEDs of the third primary color BLED1 and BLED2 and a phosphor of the mixed-primaries color, which in this case is YP. The package includes a wall dividing the package into a first receiving space and a second receiving space.

The independently drivable first light source 210 is defined by the first LED BLED1 disposed on a bottom surface of the first receiving space and by the responsively fluorescing phosphor (which outputs YP) disposed on the first LED BLED1 and filling the first receiving space.

The second light source 220 is defined as a second LED BLED2 disposed on a bottom surface of the second receiving space and a transparent resin disposed on the second LED BLED2 filling the second receiving space.

According to the present exemplary embodiment, the display panel 100 includes red, green and transparent subpixels R, G and T and the light source part 200 includes yellow and blue light sources YL and BL which are repeatedly turned on and off so that a power consumption of the display apparatus may be decreased.

Figure 13:
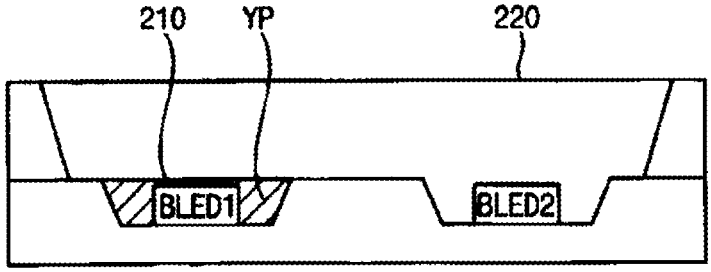
FIG. 13 is a cross-sectional view illustrating first and second light sources of a display apparatus according to another exemplary embodiment.

FIG. 13 is a cross-sectional view illustrating first and second light sources of a display apparatus according to another exemplary embodiment.

The display apparatus and the method of driving the same according to the present exemplary embodiment are substantially the same as the display apparatus and the method of driving the same in FIGS. 11 and 12 except for the light source part 200. Thus, the same reference numerals will be used to refer to the same or like parts as those described in FIGS. 11 and 12 and any repetitive explanation concerning the above elements will be omitted.

Referring to FIGS. 1, 11 and 13, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In the present exemplary embodiment, the first primary color is red. The first subpixel R is a red subpixel. The second primary color is green. The second subpixel G is a green subpixel. Alternatively, the first primary color may be red. The first subpixel may be a red subpixel. The second primary color may be blue. The second subpixel is a blue subpixel. Alternatively, the first primary color may be green. The first subpixel may be a green subpixel. The second primary color may be blue. The second subpixel is a blue subpixel.

The light source part 200 includes a first light source 210 and a second light source 220. The light source part 200 may further include a light guide plate 230. The light source part 200 generates a light and provides the light to the display panel 100.

The first light source 210 generates a light equivalent to having a mixed color of the first primary color and the second primary color. In the present exemplary embodiment, the first primary color is red, the second primary color is green, and the mixed color of the first and second primary colors is yellow. Alternatively, the mixed color of the first and second primary colors may be magenta. Alternatively, the mixed color of the first and second primary colors may be cyan. Alternatively, the first light source 210 may generate the white color. The second light source 220 generates a light having a third primary color. The third primary color may be blue.

In the present exemplary embodiment, the first light source 210 and the second light source 220 may be formed in a package. The package includes LEDs of the third primary color BLED1 and BLED2 and a phosphor for producing the mixed color which in this example is YP.

The first light source 210 is defined as a first LED BLED1 disposed on a bottom surface of a receiving space and the phosphor YP covering at least sidewalls of the first LED BLED1.

The second light source 220 is defined as a second LED BLED2 disposed on the bottom surface of the receiving space. The receiving space may be filled with a transparent resin. The transparent resin may be disposed on the phosphor YP.

According to the present exemplary embodiment, the display panel 100 includes red, green and transparent subpixels R, G and T and the light source part 200 includes yellow and blue light sources YL and BL which are repeatedly turned on and off so that a power consumption of the display apparatus may be decreased.

According to the present disclosure of invention as explained above by illustrative embodiments, a repeat group of the display panel includes subpixels dedicated to outputting some, but not all of the intended primary colors. The repeat group of the display panel further includes a transparent subpixel through which there may be passed a primary color not serviced by the dedicated subpixels of the repeat group. The display panel additionally includes a light source part that includes an independently drivable first light source having a primary color which is not serviced by the dedicated subpixels of the repeat group and an independently drivable second light source producing colors that are serviced by the dedicated subpixels. The independently drivable first light source is powered up on an as-needed basis so that a power consumption of the display apparatus may be decreased in cases where the color of the independently drivable first light source is not needed.

The foregoing is illustrative of the teachings of the present disclosure of invention and is not to be construed as limiting thereof. Although a few example embodiments have been described, those skilled in the art will readily appreciate after reading the foregoing that many modifications are possible in the example embodiments without materially departing from the novel teachings and advantages of the present disclosure of invention. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. A display apparatus comprising:

a display panel including a first subpixel having a first color, a second subpixel having a second color and a transparent subpixel; and a light source part providing a light to the display panel and including a first light source configured to generate a first light having a mixed color of the first color and the second color and a second light source configured to generate a second light having a third color, at least one of the first and second light sources being repeatedly turned on and off, wherein the light source part includes only two kinds of light sources providing at least two different colors.

2. The display apparatus of claim 1, wherein a frequency of an image displayed on the display panel including the first, second and transparent subpixels is synchronized with a frequency of turning on and off of at least one of the first and second light sources.

3. The display apparatus of claim 2, wherein the display panel displays the image at a frame rate of at least about 120 Hz, and at least one of the first and second light sources are repeatedly turned on and off at a frequency of at least about 120 Hz.

4. The display apparatus of claim 2, wherein the display panel is capable of displaying a three-dimensional ("3D") image, the display panel alternately displays a left image and a right image at a frequency of at least about 120 Hz., and at least one of the first and second light sources are repeatedly turned on and off at a frequency of at least about 240 Hz.

5. The display apparatus of claim 1, wherein the first light source is turned on during a first subframe, and the second light source is turned on during a second subframe.

6. The display apparatus of claim 5, further comprising a panel driver configured to provide respective driving signals to the first subpixel, to the second subpixel and to the transparent subpixel.

7. The display apparatus of claim 6, wherein during the first subframe, the panel driver is configured to set a grayscale data level of the first subpixel to A-min(A,B), a grayscale data level of the second subpixel to B-min(A,B) and a grayscale data level of the transparent subpixel to min(A,B), during the second subframe, the panel driver is configured to set the grayscale data level of the transparent subpixel to C, and wherein A is a grayscale of the first color, B is a grayscale of the second color, C is a grayscale of the third color and min(A,B) is a minimum value chosen as among A and B.

8. The display apparatus of claim 6, wherein during the first subframe, the panel driver is configured to set a grayscale data level of the first subpixel to A, a grayscale data level of the second subpixel to B and a grayscale data level of the transparent subpixel to A+B, during the second subframe, the panel driver is configured to set the grayscale data level of the transparent subpixel to 2C, and wherein A is a grayscale of the first color, B is a grayscale of the second color and C is a grayscale of the third color.

9. The display apparatus of claim 1, wherein the mixed color is yellow, and the third color is blue.

10. The display apparatus of claim 1, wherein the mixed color is magenta, and the third color is green.

11. The display apparatus of claim 1, wherein the mixed color is cyan, and the third color is red.

12. The display apparatus of claim 1, wherein only the first light source is turned on during a first subframe, and both the first light source and the second light source are turned on during a second subframe.

13. The display apparatus of claim 1, wherein both the first light source and the second light source are turned on during a first subframe, and only the second light source is turned on during a second subframe.

14. The display apparatus of claim 1, wherein the first light source and the second light source are formed in a package.

15. The display apparatus of claim 14, wherein the package includes a light emitting diode of the third color and a phosphor of the mixed color.

16. A method of driving a display apparatus, the method comprising:

setting grayscale data of a first subpixel having a first color, a second subpixel having a second color and a transparent subpixel;

turning on a first light source generating a first light having a mixed color of the first color and the second color; and turning on a second light source generating a second light having a third color, wherein a light source part includes only two kinds of light sources providing at least two different colors.

17. The method of claim 16, wherein at least one of the first and second light sources is repeatedly turned on and off.

18. The method of claim 17, wherein a frequency of an image displayed on the display panel including the first, second and transparent subpixels is synchronized with a frequency of turning on and off of at least one of the first and second light sources.

19. The method of claim 18, wherein the display panel displays the image at a frame rate of at least about 120 Hz, and at least one of the first and second light sources are repeatedly turned on and off at a frequency of at least about 120 Hz.

20. The method of claim 18, wherein the display panel displays a three-dimensional ("3D") image, the display panel alternately displays a left image and a right image at a frequency of at least about 120 Hz., and at least one of the first and second light sources are repeatedly turned on and off at a frequency of at least about 240 Hz.

21. The method of claim 17, wherein the first light source is turned on during a first subframe, and the second light source is turned on during a second subframe.

22. The method of claim 21, wherein during the first subframe, a grayscale data level of the first subpixel is set to A-min(A,B), a grayscale data level of the second subpixel is set to B-min(A,B) and a grayscale data level of the transparent subpixel is set to min(A,B), during the second subframe, the grayscale data level of the transparent subpixel is set to C, and wherein A is a grayscale of the first color, B is a grayscale of the second color, C is a grayscale of the third color and min(A,B) is a minimum value chosen as among A and B.

23. The method of claim 21, wherein during the first subframe, a grayscale data level of the first subpixel is set to A, a grayscale data level of the second subpixel is set to B and a grayscale data level of the transparent subpixel is set to A+B, during the second subframe, the grayscale data level of the transparent subpixel are set to 2C, and wherein A is a grayscale of the first color, B is a grayscale of the second color and C is a grayscale of the third color.

24. The method of claim 16, wherein the mixed color is yellow, and the third color is blue.

25. The method of claim 16, wherein the mixed color is magenta, and the third color is green.

26. The method of claim 16, wherein the mixed color is cyan, and the third color is red.

27. The method of claim 17, wherein only the first light source is turned on during a first subframe, and both the first light source and the second light source are turned on during a second subframe.

28. The method of claim 17, wherein both the first light source and the second light source are turned on during a first subframe, and only the second light source is turned on during a second subframe.

29. A display apparatus comprising:

a display panel including a first subpixel having a first color, a second subpixel having a second color and a transparent subpixel; and a light source part providing a light to the display panel and including a first light source configured to generate a first light which is a white light and a second light source configured to generate a second light having a third color, at least one of the first and second light sources being repeatedly turned on and off, wherein the light source part includes only two kinds of light sources providing at least two different colors.

30. The display apparatus of claim 29, wherein the first light source is turned on during a first subframe, and the second light source is turned on during a second subframe.

31. The display apparatus of claim 30, further comprising a panel driver configured to provide respective driving signals to the first subpixel, to the second subpixel and to the transparent subpixel.

32. The display apparatus of claim 31, wherein during the first subframe, the panel driver is configured to set a grayscale data level of the first subpixel to A-min(A,B,C), a grayscale data level of the second subpixel to B-min(A,B,C) and a grayscale data level of the transparent subpixel to min(A,B,C), during the second subframe, the panel driver is configured to set the grayscale data level of the transparent subpixel to C-min(A,B,C), and wherein A is a grayscale of the first color, B is a grayscale of the second color, C is a grayscale of the third color and min(A,B,C) is a minimum value chosen as among A, B and C.

33. The display apparatus of claim 31, wherein during the first subframe, the panel driver is configured to set a grayscale data level of the first subpixel to A, a grayscale data level of the second subpixel to B and a grayscale data level of the transparent subpixel to A+B+C, during the second subframe, the panel driver is configured to set the grayscale data of the transparent subpixel to C, and wherein A is a grayscale of the first color, B is a grayscale of the second color and C is a grayscale of the third color.

34. The display apparatus of claim 29, wherein only the first light source is turned on during a first subframe, and both the first light source and the second light source are turned on during a second subframe.

35. The display apparatus of claim 29, wherein both the first light source and the second light source are turned on during a first subframe, and only the second light source is turned on during a second subframe.

36. A method of driving a display apparatus, the method comprising:

setting grayscale data of a first subpixel having a first color, a second subpixel having a second color and a transparent subpixel;

turning on a first light source generating a first light which is a white light; and turning on a second light source generating a second light having a third color, wherein a light source part includes only two kinds of light sources providing at least two different colors.

37. The method of claim 36, wherein at least one of the first and second light sources is repeatedly turned on and off.

* * * * *